51-372 AU 324 EX
10/15/85 4,546,576

United States Patent [19]
Dreiling

[11] Patent Number: 4,546,576
[45] Date of Patent: Oct. 15, 1985

[54] POLISHING APPARATUS HAVING AN EXPANDABLE HEAD

[75] Inventor: Peter M. Dreiling, Sheboygan, Wis.

[73] Assignee: Hi-Lite Polishing Machine Co. Inc., Sheboygan, Wis.

[21] Appl. No.: 580,687

[22] Filed: Feb. 16, 1984

[51] Int. Cl.[4] ..... B24D 9/02
[52] U.S. Cl. ..... 51/372
[58] Field of Search ..... 51/358, 372, 373, 375

[56] References Cited

U.S. PATENT DOCUMENTS 2,391,449 12/1945 Elliott ..... 51/375
2,485,786 10/1949 Strout ..... 51/375
2,770,926 11/1956 Holmlund ..... 51/375
2,812,625 11/1957 Scala ..... 51/375

*Primary Examiner*—Robert P. Olszewski
*Attorney, Agent, or Firm*—Andrus, Sceales, Starke & Sawall

[57] ABSTRACT

An apparatus for polishing a metal article, including a tapered mandrel adapted to be connected to a power source. The tapered mandrel is received within the tapered interior of an expandable hub that is provided with a plurality of longitudinally extending slots. One group of slots extends from one end of the hub and terminates short of the opposite end of the hub, while a second group of slots is spaced between the first slots and extend from the second end of the hub and terminate short of the first end. A series of outwardly projecting longitudinal ribs are located between adjacent slots. The hub is positioned within a resilient sleeve having a plurality of internal longitudinal grooves to receive the ribs, and the outer surface of the sleeve receives an abrasive band. By threading a stud in the outer end of the mandrel, the tapered mandrel is drawn inwardly of the hub to expand the hub and firmly secure the abrasive band to the sleeve. Through use of the ribs, an effective power transmission is obtained between the mandrel and the abrasive band to accommodate high speed, high pressure polishing of metal articles.

3 Claims, 5 Drawing Figures

FIG. 1
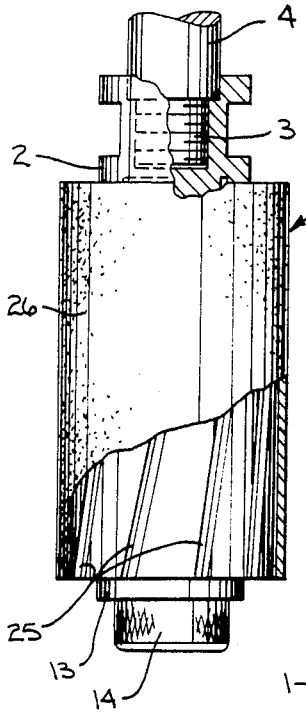
FIG.5
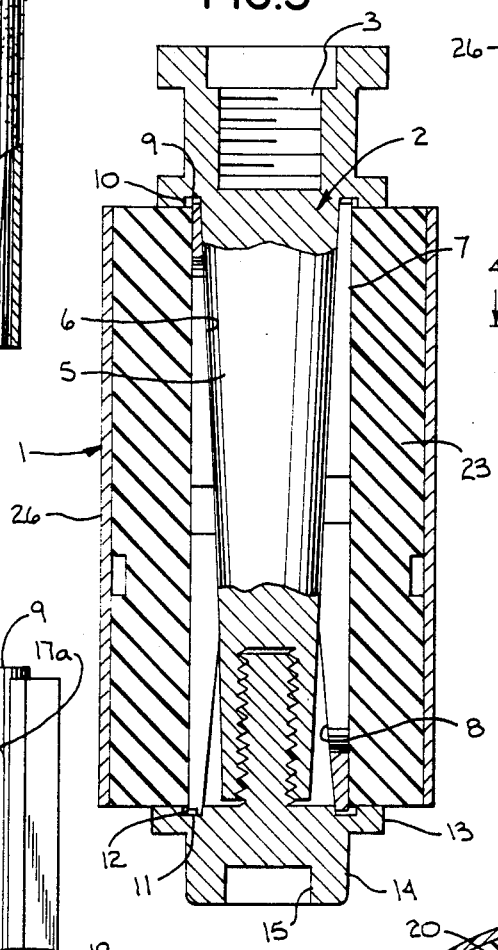
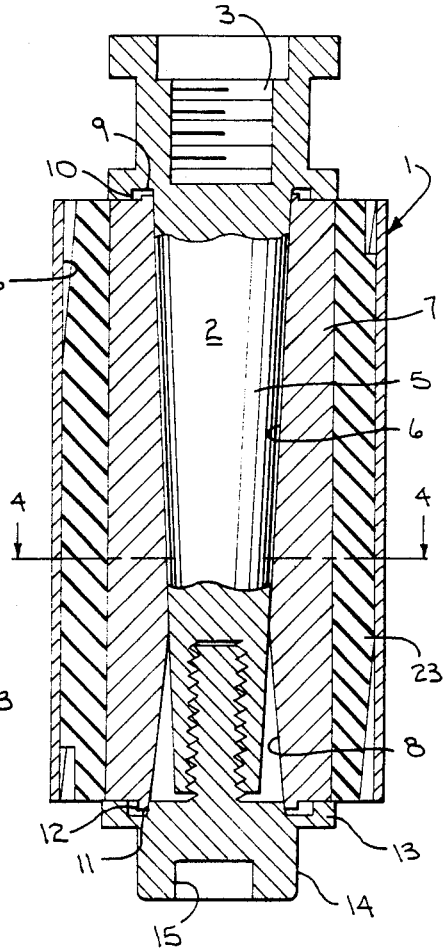
FIG. 2
FIG.3
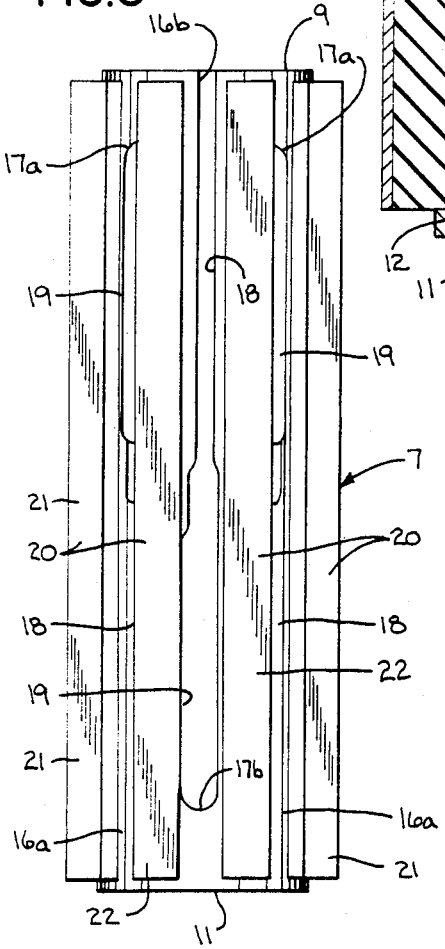
FIG.4
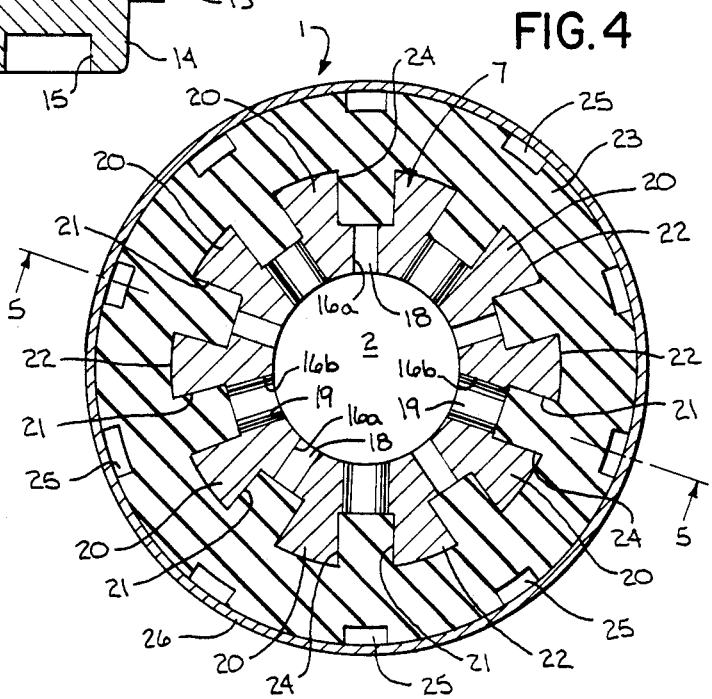

POLISHING APPARATUS HAVING AN EXPANDABLE HEAD

BACKGROUND OF THE INVENTION

Polishing of metal articles, such as kitchen sinks, cookware, etc., is normally carried out under high speed conditions, up to 7,000 rpm, and with substantial pressure being applied by the polishing head to the metal workpiece. It is important in polishing metal articles to have a positive drive transmission between the driving source and the abrasive band to prevent slippage of the band during the high speed, high pressure operating conditions.

In the past, a typical polishing head has been composed of a central rotatable shaft with a rubber sleeve bonded to the shaft. The outer surface of the rubber sleeve has been provided with a series of circumferentially spaced, longitudinal slots that are cut at an angle to the radius of the sleeve. The abrasive band is manually installed on the rubber sleeve by twisting the sleeve in a direction to compress the slots, thereby reducing the external diameter of the sleeve, and then slipping the band over the compressed sleeve. Installation of the abrasive band is a very difficult operation, requiring considerable strength and dexterity, particularly when the polishing head is mounted vertically in a polishing machine. Depending on the particular article being polished, it is often necessary to replace the abrasive band numerous times during a working shift.

It is also known in the woodworking art to mount a sandpaper belt on an expandable hub, as shown in U.S. Pat. Nos. 1,395,468, 154,756, 1,570,166 and 2,083,793. In this type of construction, as described in the aforementioned patents, a tapered mandrel is inserted within an expandable hub, causing the hub to expand radially and grip the abrasive band. However, this type of mounting of the abrasive band, while operable under low speed conditions on wood, has not been successfully employed with high speed, high pressure metal polishing operations.

SUMMARY OF THE INVENTION

The invention is directed to an improved apparatus for polishing metal articles, and more particularly to a polishing head having an improved mechanism for mounting an abrasive band. In accordance with the invention, the polishing head includes a tapered mandrel which is received within the tapered interior of an expandable hub. The hub is provided with a first group of longitudinally extending slots that extend from one end of the hub and terminate short of the second end. In addition, the hub is provided with a second group of longitudinal slots which are spaced between the first slots and extend from the second end of the hub and terminate short of the first end.

In addition, the hub is provided with a plurality of outwardly extending longitudinal ribs which are located between adjacent slots.

Located outwardly of the expandable hub is a resilient, rubber-like sleeve having a plurality of internal grooves which receive the ribs on the hub. The abrasive band is positioned on the outer surface of the resilient sleeve.

By threading a stud into the outer end of the mandrel, the tapered mandrel is drawn into the hub, thereby expanding the hub and providing a firm connection between the driving source and the abrasive band.

Due to the external ribs on the hub that mate with grooves in the resilient sleeve, a positive transmission of power is achieved between the hub and the sleeve which prevents slippage under high speed, high pressure polishing operations.

When worn, the abrasive band can be readily replaced by loosening the stud to contract the hub. With the hub contracted the abrasive band can be slipped off of the polishing head and the new band installed. By tightening the stud, the hub will be expanded to firmly secure the band to the resilient sleeve.

As an additional feature of the invention, the ends of the expandable hub are engaged within grooves in the mandrel and in the stud. The engagement of the ends of the hub with the grooves prevents the hub from flying outwardly in the event the hub should fracture under high speed operation.

Other objects and advantages will appear in the course of the following description.

DESCRIPTION OF THE DRAWINGS

The drawings illustrate the best mode presently contemplated of carrying out the invention.

In the drawings:

FIG. 1 is a side elevation of the polishing hub of the invention with parts broken away in section;

FIG. 2 is a longitudinal section of the polishing head;

FIG. 3 is a plan view of the expandable hub;

FIG. 4 is a section taken along line 4—4 of FIG. 2; and

FIG. 5 is a longitudinal section taken along line 5—5 of FIG. 4.

DESCRIPTION OF THE ILLUSTRATED EMBODIMENT

FIG. 1 illustrates a polishing head 1 which can be used for polishing metal articles, such as kitchen sinks, cookware, or the like. In practice, the head 1 is normally installed vertically in a polishing machine, but in certain installations, it may assume different orientations.

Polishing head 1 includes a tapered mandrel 2 and the upper end of mandrel 2 is provided with a tapped hole 3 which receives the end of a driving spindle 4 that is connected to a suitable source of power to thereby rotate the polishing head about its axis.

Mandrel 2 has an outer tapered body 5 which is received within the upper tapered interior 6 of an expandable hub 7. The lower end of hub 7 is provided with a lower tapered section 8 which communicates with upper tapered section 6 and diverges downwardly and outwardly. The tapered section 8 provides the lower end of the hub with a thickness similar to that of the upper end of the hub so that both ends of the hub will expand generally uniformly.

As best shown in FIGS. 2 and 5 the upper end 9 of hub 7 is received within an annular groove 10 formed in the flange of mandrel 2, while the lower end 11 of hub 7 is received within a groove 12 formed in the flange 13 of threaded stud 14. However, ends 9 and 11 do not bottom out in the respective grooves 10 and 12. Stud 14 is threaded within a tapped opening in the end of mandrel 2, and by threading down of stud 14, the tapered mandrel will be drawn inwardly within the hub 7, causing the hub to expand radially outward.

To facilitate the threading down of stud 14, the outer end of the stud is provided with a hex-shaped opening 15 into which an Allen wrench or other tool can be inserted. Threads on stud 14 are of the opposite hand from the direction of rotation of the head to prevent loosening of the stud during operation.

Hub 7 is provided with a plurality of longitudinally extending slots 16. One group of slots 16*a* extend from the lower end of the hub and terminate at a base 17*a* spaced from the upper end of the hub, while a second group of slots 16*b* extend from the upper end of the hub and terminate at a base 17*b* spaced from the lower end of the hub.

As best shown in FIG. 3 each slot 16 is provided with a narrow section 18 and a wider section 19 which terminates at the base 17. The wider sections 19 of the slots 16 located adjacent base 17 aid in providing a more uniform expansion of the hub 7.

In addition to slots 16, the hub 7 is also provided with a plurality of outwardly extending longitudinal ribs 20 which are located between adjacent slots 16. As shown in FIG. 4, each rib 20 is provided with a pair of outwardly diverging side walls 21 which terminate in an outer surface 22. As illustrated in FIG. 3, the ribs 20 extend substantially the entire length of the hub 6 and as the hub is expanded, ribs 20 will be deformed to a slightly snake-like or sinuous configuration.

Located outwardly of hub 7 is a resilient sleeve 23 formed of rubber or an elastomeric material. Sleeve 23 is provided with a plurality of internal grooves 24 which receive ribs 20 on hub 7. In addition, the outer surface of sleeve 23 is formed with a series of diagonally extending grooves 25 and an abrasive band 26 is mounted on the outer surface of sleeve 23. Grooves 25 aid in the polishing operation by providing a relief for swarf and they also reduce the noise level.

The polishing head 1 is normally installed in an automatic polishing machine, although it is contemplated that the polishing head could, in some cases, be utilized with a manual tool. In normal operation, the head 1 is disposed vertically and is adapted to operate against the side wall of kitchen sinks or against the side wall of metal cookware.

To replace the abrasive band 26, stud 14 is loosened, causing hub 7 to contract, thereby loosening the connection of the abrasive band 26 to sleeve 23. The abrasive band can then be slipped downwardly from the polishing head and a new band installed. By threading down the stud 14, the tapered mandrel 2 is drawn into the tapered interior 6 of hub 7 causing the hub to expand outwardly and flanges 10 and 13 bear firmly against the ends of sleeve 23 to increase the driving force. Expansion of the hub causes a corresponding expansion of sleeve 23 to thereby firmly grip the abrasive band 26.

While the drawings illustrate the ribs 20 as being undercut, it is contemplated that the ribs can have other configurations. The undercut configuration of the ribs, as shown in FIG. 4, provides more expanding power due to the greater surface area at the surfaces 22.

The ribs 20, in combination with slots 16, provide a hub which can be readily expanded yet achieves a positive driving connection between the mandrel and the resilient sleeve.

Various modes of carrying out the invention are contemplated as being within the scope of the following claims particularly pointing out and distinctly claiming the subject matter which is regarded as the invention.

I claim:

1. An apparatus for polishing a metal article, comprising a tapered mandrel to be connected to a rotatable power source, an annular expandable hub disposed around the mandrel and having a tapered inner surface to complement the tapered mandrel, said hub having a plurality of longitudinally extending first slots each having an open first end disposed at a first end of the hub and terminating at a first base disposed in spaced relation to the second end of said hub, said hub also having a plurality of longitudinally extending second slots each having an open second end disposed at said second end of the hub and terminating at a second base disposed in spaced relation to the first end of the hub, a plurality of outwardly extending longitudinal ribs circularly spaced about the hub and formed as part of said hub, each of said ribs being disposed between a pair of adjacent first and second slots, a resilient sleeve disposed around the hub and having a plurality of longitudinally extending internal grooves to receive said ribs to thereby prevent relative rotation between the hub and the resilient sleeve, an abrasive band disposed on the outer surface of said sleeve, and means engageable with the outer end of said mandrel for drawing the tapered mandrel inwardly of said hub to thereby expand the hub and provide a firm driving connection between the mandrel and the abrasive band.

2. The apparatus of claim 1, wherein each slot has a wide portion disposed adjacent the base and a narrow portion spaced from the wide portion in a direction away from said base, said wide portion having a greater circumferential dimension than said narrow portion, said wide and narrow portions of each slot extending approximately one half the length of said slot.

3. The apparatus of claim 1, wherein said mandrel has a first laterally extending flange engaged with an end of the sleeve, the outer end of the mandrel having a threaded axial bore, a stud engaged with said bore and having a second laterally extending flange engaged with the opposite end of said sleeve, said first flange having a first circumferential groove and said second flange having a second circumferential groove, the ends of the hub projecting outwardly beyond the corresponding ends of said ribs and the ends of the hub being received within the respective grooves.

* * * * *

51-372 AU 327 EX

CCC13 CR 4,546,576

UNITED STATES PATENT AND TRADEMARK OFFICE

CERTIFICATE OF CORRECTION

PATENT NO. : 4,546,576

DATED : October 15, 1985

INVENTOR(S) : PETER M. DREILING

It is certified that error appears in the above-identified patent and that said Letters Patent is hereby corrected as shown below: On the title page, At "[56[ References Cited" add the following:

---154,756 Howe
1,395,468 Beal
1,452,769 Warner
1,570,166 Morris
1,960,555 Sims
2,083,793 Price---

Col. 3 Line 25 After "hub" delete "6" and substitute therefor ---7---

Signed and Sealed this

First Day of April 1986

[SEAL]

Attest:

DONALD J. QUIGG

Attesting Officer

Commissioner of Patents and Trademarks